US011857070B2

(12) United States Patent
Janser

(10) Patent No.: US 11,857,070 B2
(45) Date of Patent: Jan. 2, 2024

(54) DRIVE DEVICE FOR A MOVEABLE FURNITURE PART

(71) Applicant: Julius Blum GmbH, Hoechst (AT)

(72) Inventor: Pascal Janser, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 145 days.

(21) Appl. No.: 17/476,813

(22) Filed: Sep. 16, 2021

(65) Prior Publication Data

US 2022/0000264 A1 Jan. 6, 2022

Related U.S. Application Data

(63) Continuation of application No. PCT/AT2020/060029, filed on Jan. 31, 2020.

(30) Foreign Application Priority Data

Mar. 20, 2019 (AT) ..... A 50237/2019

(51) Int. Cl.
*A47B 88/463* (2017.01)
*A47B 88/45* (2017.01)

(52) U.S. Cl.
CPC ..... *A47B 88/463* (2017.01); *A47B 88/45* (2017.01)

(58) Field of Classification Search
CPC ..... A47B 88/45; A47B 88/463; A47B 2210/0078
See application file for complete search history.

(56) References Cited

U.S. PATENT DOCUMENTS 9,295,328 B2 3/2016 Brunnmayr
9,642,461 B2 5/2017 Goetz et al.
9,717,334 B2 8/2017 Goetz et al.
(Continued)

FOREIGN PATENT DOCUMENTS

CN 105142460 12/2015
CN 105228490 1/2016
(Continued)

OTHER PUBLICATIONS

International Search Report dated Apr. 7 , 2020 in International (PCT) Application No. PCT/AT2020/060029.

*Primary Examiner* — James O Hansen
(74) *Attorney, Agent, or Firm* — Wenderoth, Lind & Ponack, L.L.P.

(57) ABSTRACT

A drive device includes a carrier extending in the closing direction of a moveable furniture part, an ejection device for ejecting the moveable furniture part into an open position, and a locking device for locking the ejection device in a locked position. The locking device has a locking pin connected to the ejection device and a guide track for the locking pin formed in or on the carrier, and a synchronization device for synchronizing the movement of the drive device with a second drive device. The synchronization device has a transmission element moveably mounted on the carrier to be moved by the locking pin, and a synchronization coupling element connected to the transmission element. The guide track has a maximum guide track width measured perpendicular to the closing direction, and the synchronization coupling element and the ejection force store are arranged within this guide track width in the closing direction.

12 Claims, 15 Drawing Sheets

(56) References Cited

U.S. PATENT DOCUMENTS

| | | | | |
|---|---|---|---|---|
| 10,051,962 | B2 | 8/2018 | Goetz | |
| 10,070,721 | B2 | 9/2018 | Brunnmayr et al. | |
| 10,405,653 | B2 | 9/2019 | Goetz et al. | |
| 10,575,637 | B2 | 3/2020 | Wohlgenannt | |
| 10,750,861 | B2 | 8/2020 | Wohlgenannt | |
| 2012/0038255 | A1* | 2/2012 | Netzer | A47B 88/463 312/319.1 |
| 2014/0319986 | A1 | 10/2014 | Brunnmayr | |
| 2015/0374125 | A1 | 12/2015 | Goetz et al. | |
| 2016/0007750 | A1 | 1/2016 | Goetz et al. | |
| 2016/0206093 | A1 | 7/2016 | Brunnmayr et al. | |
| 2016/0227927 | A1 | 8/2016 | Goetz | |
| 2017/0020285 | A1 | 1/2017 | Schallert et al. | |
| 2017/0051813 | A1* | 2/2017 | Karu | A47B 88/463 |
| 2018/0020833 | A1 | 1/2018 | Goetz et al. | |
| 2018/0160807 | A1 | 6/2018 | Wohlgenannt | |
| 2018/0160808 | A1 | 6/2018 | Wohlgenannt | |

FOREIGN PATENT DOCUMENTS

| | | |
|---|---|---|
| CN | 106455811 | 2/2017 |
| CN | 107708488 | 2/2018 |
| CN | 109171265 | 1/2019 |
| DE | 20 2015 001 186 | 4/2015 |
| DE | 10 2016 113 043 | 1/2018 |
| DE | 10 2016 120 586 | 5/2018 |
| EP | 3 054 811 | 12/2018 |
| JP | 2015-507508 | 3/2015 |
| JP | 2016-518176 | 6/2016 |
| JP | 2018-524104 | 8/2018 |
| WO | 2010/075614 | 7/2010 |
| WO | 2015/058222 | 4/2015 |
| WO | 2015/154107 | 10/2015 |
| WO | 2016/164942 | 10/2016 |
| WO | 2017/004638 | 1/2017 |
| WO | 2017/004639 | 1/2017 |

* cited by examiner

OS

OS+VS

ÜS

OS

DRIVE DEVICE FOR A MOVEABLE FURNITURE PART

BACKGROUND OF THE INVENTION

The present invention concerns a drive device for a moveable furniture part, in particular for a drawer, comprising a carrier which extends in the closing direction of the moveable furniture part, and an ejection device for ejecting the moveable furniture part out of a closed position into an open position. The ejection device has an ejection slide moveable relative to the carrier, and an ejection force storage means is fixed on the one hand to the carrier and on the other hand to the ejection slide. The ejection device is unlockable out of a locking position by an overpressing movement of the moveable furniture part into an overpressing position behind the closed position, and a locking device is provided for locking the ejection device in the locking position. The locking device has a locking pin connected to the ejection device, and a guide track is provided at least partially in or on the carrier for the locking pin. The locking pin in the locking position is locked in a latching recess in the guide track, and a synchronization device is provided for synchronizing the movement of the drive device with a second drive device. The synchronization device has a transmission element which is mounted moveably to the carrier and is moveable by the locking pin, and a synchronization coupling element connected to the transmission element. In addition, the invention concerns an arrangement comprising two synchronized drive devices. Furthermore the invention concerns an article of furniture having such a drive device.

For many years now, furniture fitments which assist with the movements of moveable furniture parts (like for example drawers, doors and flaps of articles of furniture) have been produced and used. So-called touch-latch mechanisms are known, with which an opening movement is triggered by pressing against the moveable furniture part. The action of pressing ("touch") against the moveable furniture part while in the closed position releases locking ("latch") of the locking device whereby the ejection device opens the moveable furniture part.

An example of a furniture fitment of that kind or for such a drive device is to be found in WO 2017/004638 A1. The locking pin after the overpressing action at the beginning of the opening movement moves a locking element which is provided on the partially sleeve-shaped synchronization coupling portion. That synchronization coupling portion corresponds to the transmission element of the present invention. A disadvantage in that specification is that the carrier is relatively wide as the synchronization teeth are disposed laterally beside the guide track.

A similar consideration applies to EP 3 054 811 B1. Therein, the coupling element corresponds to the transmission element of the present invention. The synchronization teeth arranged on the coupling element are disposed laterally beside the guide track.

DE 10 2016 113 043 A1 and DE 10 2016 120 586 A1 disclose drive devices which are relatively wide. The adjusting element shown in the first-mentioned specification partially corresponds to the transmission element of the present invention. The limb disposed on that adjusting element can be interpreted as the synchronization coupling element. A disadvantage with such a drive device is that it is relatively wide. On the one hand the limb on the adjusting element is wider than the remaining region of the adjusting element. In particular however the force storage means are disposed laterally beside the guide track.

SUMMARY OF THE INVENTION

The object of the present invention is therefore to provide a drive device which is improved over or is an alternative to the state of the art. In particular the invention aims to provide that the drive device is as narrow as possible. In addition the drive device is to be of a simple structure, take up relatively little space and include few components.

Accordingly, in accordance with the invention, the guide track has a maximum guide track width measured at a right angle to the closing direction. When viewed in the closing direction, the synchronization coupling element and the ejection force storage means (ejection force accumulator) are arranged within that maximum guide track width. That makes it possible to have a relatively narrow structure.

That is to say, neither the synchronization coupling element nor the ejection force storage means are wider than the maximum guide track width. In addition, as viewed in the closing direction, they do not project beyond the maximum guide track width. In other words, the synchronization coupling element and the ejection force storage means lie within a plane defined by the maximum guide track width and the closing direction. Once again expressed another way, the end points of the maximum guide track width are respectively arranged in a limit plane (boundary plane) oriented at a right angle to the maximum guide track width. Those two limit planes are parallel to each other. The synchronization coupling element and the ejection force storage means (ejection force accumulator) are disposed entirely between those limit planes. Other components of the drive device can be at least partially arranged outside those limit planes.

In the installed position, the synchronization coupling element itself can be arranged above, below or in front of the guide track. Preferably, however, the synchronization coupling element is arranged behind the guide track on the carrier in the closing direction.

The ejection force storage means in the installed position itself can also be arranged above, below, or behind the guide track. Preferably, however, the ejection force storage means is arranged in front of the guide track in the closing direction.

To permit the drive device to have a narrow structure, preferably as viewed in the closing direction, the transmission element is arranged within the guide track width.

Also preferably, the synchronization coupling element as measured at a right angle to the closing direction has a smaller maximum width than the maximum width of the transmission element as measured at a right angle to the closing direction.

The guide track itself can have any desired design configuration. Preferably, the guide track has a cardioid-shaped portion. For example, the locking pin can be locked in the locking position in the latching recess of the guide track, in which case the latching recess is at least partially formed by a locking element which is moveable relative to the carrier and the locking pin is held in the locking position to the locking element. Particularly preferably, the locking element is arranged on the transmission element.

In principle, it is possible for the transmission element to be mounted rotatably to the carrier. With a narrow design configuration for the drive device, it is however advantageous if the transmission element is linearly moveable in the closing direction.

The synchronization coupling element can be in the form of a lever. Preferably, however, the synchronization coupling element has a plurality of teeth spaced from each other in the closing direction.

In matching relationship therewith, the synchronization device has a synchronization coupling counterpart element which is mounted rotatably to the carrier and which is preferably in the form of a toothed wheel and which can be coupled in motion-transmitting relationship to the synchronization coupling element.

The drive device described hitherto does not have to be used for synchronization or for transmission of movement to a second drive device. Rather, such a drive device can also be installed only individually (and at one side) in an article of furniture. Then the drive device admittedly (actually unnecessarily) also has the components for synchronization, but a drive device of that kind is advantageous insofar as only one kind of drive device (therefore always having synchronization components) has to be produced. That facilitates for example storage and simplifies and unifies production.

The invention relates not only to a single drive device but also to an arrangement having a (first) drive device according to the invention and a second drive device according to the invention which is synchronized therewith. Preferably, that arrangement also has a synchronization bar for connecting the synchronization devices, in particular the synchronization coupling counterpart elements, of the two drive devices.

In addition, the invention relates to an article of furniture comprising a furniture carcass, at least one furniture part moveable relative to the furniture carcass, and a drive device according to the invention or an arrangement with two drive devices. Preferably, those two drive devices are mounted at opposite sides of the furniture carcass or the moveable furniture part.

The carriers of the drive devices can be fixed to the moveable furniture part (or to a drawer rail of a drawer extension guide assembly), in which case then the ejection devices eject together with the moveable furniture part on entrainment members (associated with the furniture carcass). Preferably, however, the carriers of the drive devices are fixed to the furniture carcass (preferably each at a carcass rail of a drawer extension guide assembly). The ejection devices move the moveable furniture part relative to the furniture carcass in the opening direction by way of entrainment members (associated with the moveable furniture part).

BRIEF DESCRIPTION OF THE DRAWINGS

Further details and advantages of the present invention are described more fully hereinafter by means of the specific description with reference to the embodiments by way of example illustrated in the drawings in which.

DETAILED DESCRIPTION OF THE INVENTION

Figure 1:
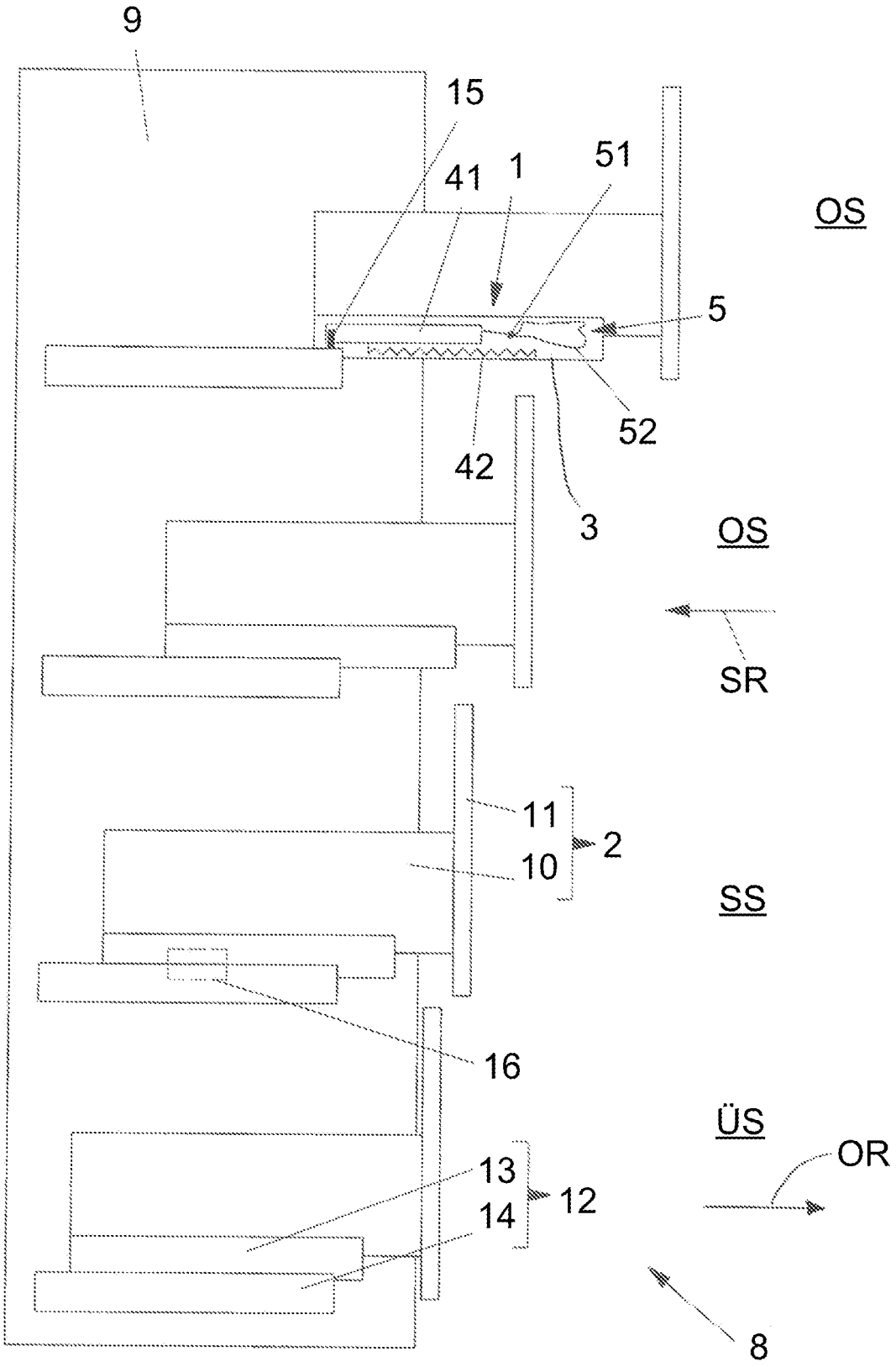
FIG. 1 diagrammatically shows an article of furniture with a plurality of moveable furniture parts in the form of drawers.

FIG. 1 quite generally shows an article of furniture 8 comprising a furniture carcass 9 and a total of four moveable furniture parts 2. Each furniture part 2 comprises at least a drawer receptacle box 10 and a front panel 11. The moveable furniture parts 2 are fixed to the furniture carcass 9 by a drawer extension guide assembly 12 comprising a drawer rail 13 and a carcass rail 14 (and possibly a central rail which is not shown).

A drive device 1 is diagrammatically shown in relation to the uppermost drawer. The drive device 1 has a carrier 3. In this case, the carrier 3 is mounted to the drawer rail 13 (in the diagrammatic view in FIG. 1 the carrier 3 corresponds to the drawer rail 13). The drive device 1 has an ejection device 4, the ejection slide 41 and the ejection force storage means (ejection force accumulator) 42 of the ejection device 4 being shown diagrammatically. The locking device 5 has a guide track 52 which is provided in the carrier 3 and the locking pin 51 guided in the guide track 52 (which in this case is of a cardioid shape). Arranged on the carcass rail 14 (or on the furniture carcass 9 itself) is an entrainment member 15, with which the ejection device 4 is at least portion-wise in engagement. The arrangement however can also be reversed. That is to say, the drive device 1 can be associated with the carcass rail 14 while the entrainment member 15 is associated with the moveable furniture part 2. This uppermost drawer is in the open position OS.

When the drawer is moved from that open position OS in the closing direction SR then the locking pin 51 is displaced in the closing portion C of the guide track 52 (see hereinafter in the detail). In that case, the ejection force storage means 42 is stressed by a relative movement between the ejection slide 41 and the carrier 3.

The ejection force storage means (ejection force accumulator) 42 is fully stressed in the closed position (third drawer from the top). That closed position SS can be reached by a purely manual closing movement. Alternatively, the moveable furniture part 2—if present—can be moved or retracted into the closed position SS by the retraction device 16 (only diagrammatically illustrated) which is integrated in the extension guide assembly 12.

Starting from that closed position SS, the moveable furniture part 2 moves into the overpressing position ÜS (lowermost drawer in FIG. 1) by pressing against the moveable furniture part 2. The locking device 5 is unlocked as a result. After the overpressing action, which is performed in the closing direction SR, the moveable furniture part 2—as soon as the user is no longer pressing against the moveable furniture part 2—is ejected in the opening direction OR by the drive device 1. As a result the moveable furniture part 2 moves into the open position OS as shown by the second drawer from the top. In that position, the drawer can be gripped, for example, by the front panel 11 and manually moved further into the position shown by the first drawer from the top.

Figure 2:
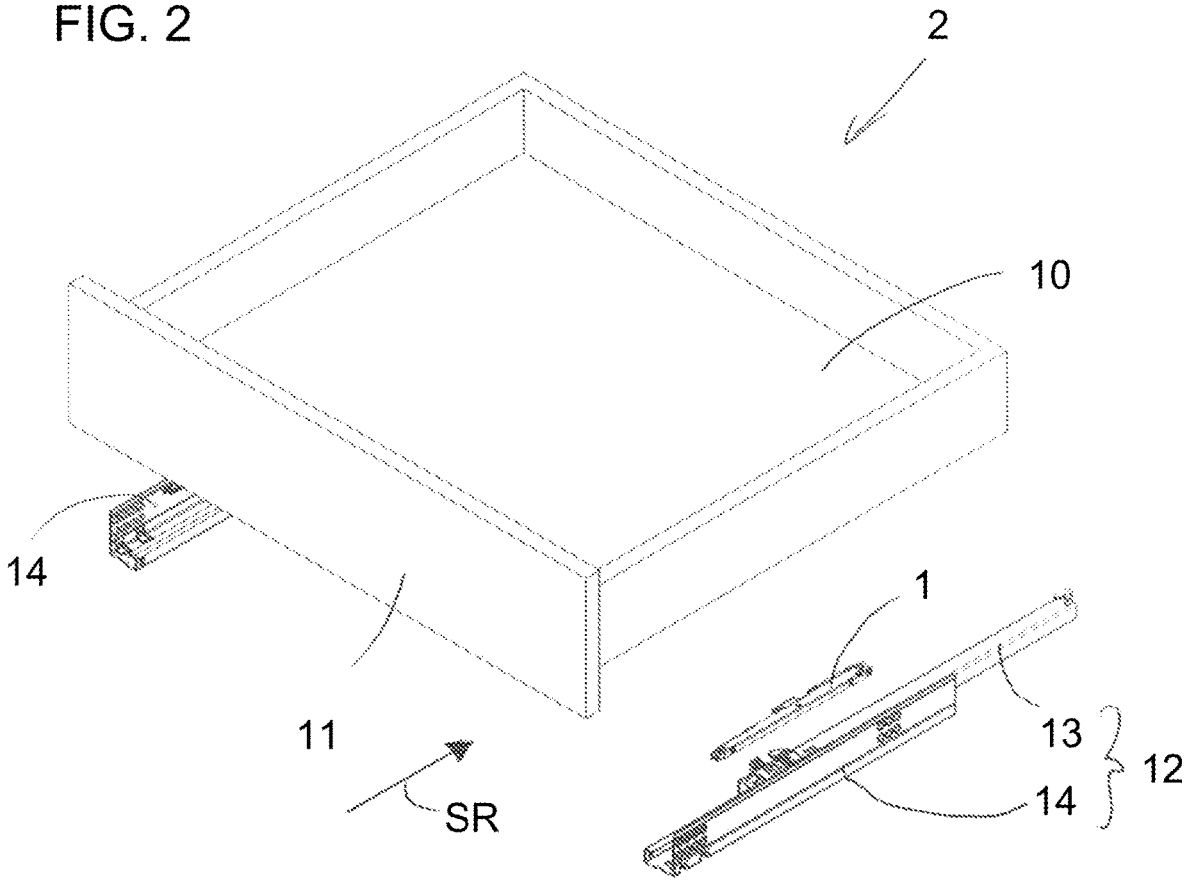
FIG. 2 is a perspective view of a drawer with drawer extension guide assemblies and a drive device for a moveable furniture part.

FIG. 2 shows a perspective view of a moveable furniture part 2 in the form of a drawer with a drawer receptacle box 10 and a front panel 11. The Figure also shows a drawer extension guide assembly 12 comprising a drawer rail 13 and a carcass rail 14, wherein a drawer extension guide assembly 12 is provided on both sides of the moveable furniture part 2. FIG. 2 further shows a drive device 1. The drive device 1 is mounted to the carcass rail 14. That drive device 1 (or its carrier 3) extends in the closing direction SR of the moveable furniture part 2. In particular, in the case of smaller or narrower drawers, it is sufficient if only one drive device 1 is associated with the moveable furniture part 2. That can be associated with the right-side drawer extension guide assembly 12 (as shown) but also the left-side drawer extension guide assembly 12.

Figure 3:
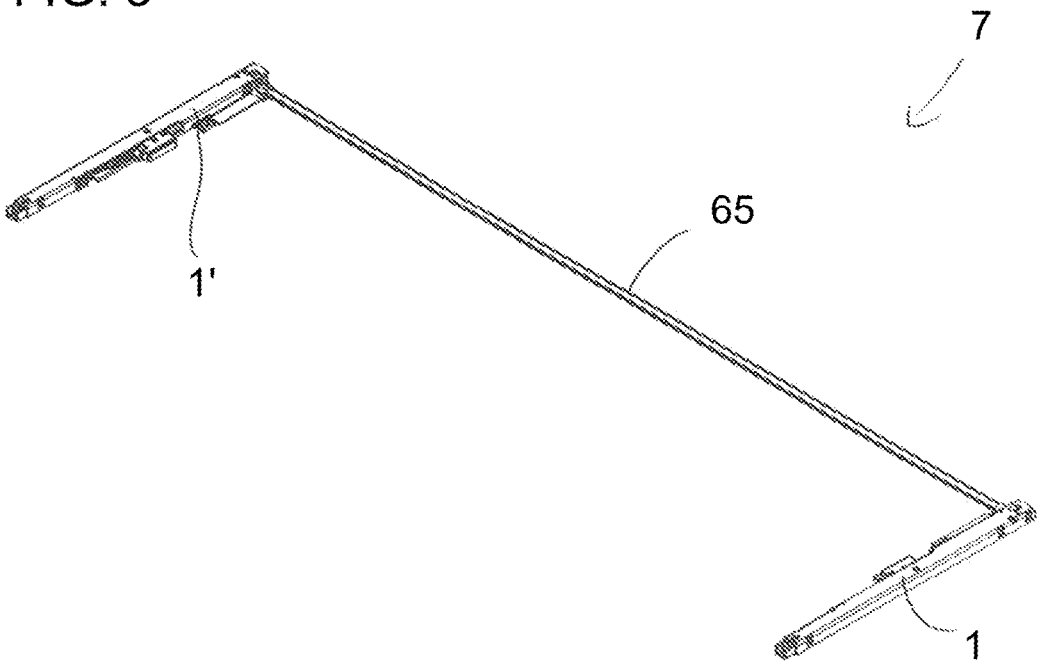
FIG. 3 shows an arrangement comprising two synchronized drive devices.

In the case of wider or larger drawers, it is advantageous—in particular to avoid tilting or jamming of the drawer in the furniture carcass 9—if mutually synchronized drive devices 1 and 1' are provided on both sides of the moveable furniture part. In matching relationship therewith, FIG. 3 shows an arrangement 7 comprising a (first) drive device 1 and a second drive device 1'. Those two drive devices 1 and 1' are connected together by way of a synchronization bar 65. More specifically, portions of the opening movement and the closing movement of the drive devices 1 and 1' are synchronized with each other. The first drive device 1 is of a mirror-image symmetrical configuration with the second drive device 1'. Otherwise, the drive devices 1 and 1' are of an identical configuration.

Figure 4:
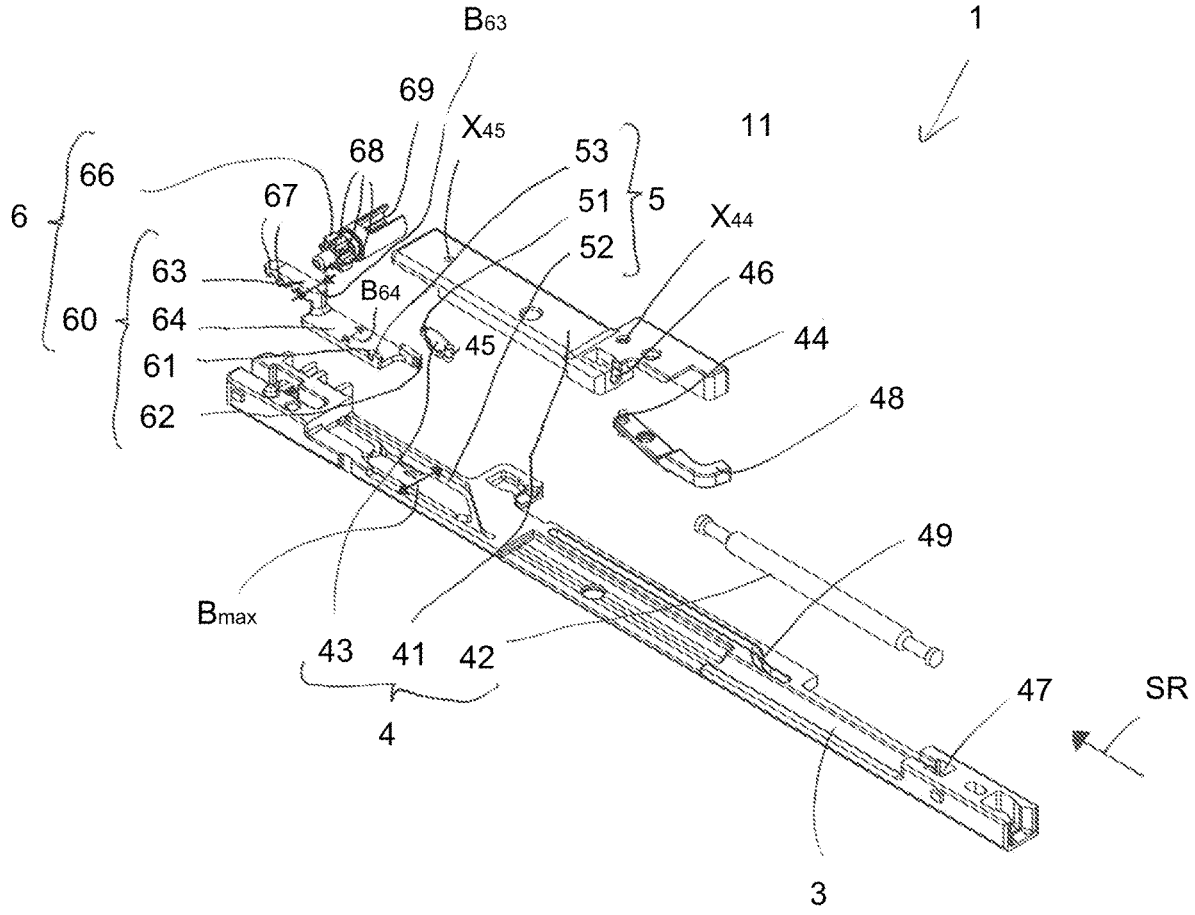
FIG. 4 is an exploded perspective view of the drive device.

FIG. 4 shows an exploded perspective view of a drive device 1. That drive device 1 has an elongated carrier 3. The carrier 3 is releasably connected to the drawer rail 13. Snap connections or screw connections for example can be provided for that purpose. A cardioid-shaped guide track 52 for the locking pin 51 is formed in the carrier 3. The guide track 52 together with the locking element 53 and the locking pin 51 form the locking device 5 for the ejection device 4.

The ejection device 4 in turn has the ejection slide 41, the control lever 43 which is mounted moveably (preferably rotatably) to the ejection slide 41 and the ejection force storage means 42. The ejection slide 41 is linearly displaceably mounted to the carrier 3. Provided in the ejection slide 41 is an axis of rotation $X_{45}$. The control lever 43 is mounted rotatably in or at that axis of rotation $X_{45}$, with its axis counterpart portion 45. The locking pin 51 is arranged or formed on the control lever 43. The first force storage means base 46 is provided in the ejection slide 41. The second force storage means base 47 is provided on the carrier 3. The ejection force storage means 42 in the form of a tension spring is fixed with one end to the first force storage means base 46 and with the other end to the second force storage means base 47. The axis of rotation $X_{44}$ for the entrainment catch lever 48 is provided on the ejection slide 41. That lever 48 is mounted rotatably by the axis counterpart portion 44 in the axis of rotation $X_{44}$. The entrainment catch lever 48 is guided by a guide element in the sliding guide track 49 in the carrier 3.

The drive device 1 also has a synchronization device 6. The synchronization device 6 includes on the one hand a transmission element 60 linearly moveable on the carrier. The transmission element 60 in turn has a carrier body 64, a first transmission abutment 61, a second transmission abutment 62 and a synchronization coupling element 63. The synchronization coupling element 63 has teeth 67 spaced from each other in the closing direction SR. On the other hand, the synchronization device 6 also includes a synchronization coupling counterpart element 66. The synchronization coupling counterpart element 66 is mounted rotatably to the carrier 3. The synchronization coupling counterpart element 66 has a toothed wheel with teeth 68. The teeth 68 of the synchronization coupling counterpart element 66 mesh with the teeth 67 of the synchronization coupling element 63. The synchronization bar 65 can be fixed in the receiving means 69 provided in the synchronization coupling counterpart element 66.

It can also be seen from FIG. 4 that the synchronization coupling element 63, measured at a right angle to the closing direction SR, has a smaller maximum width $B_{63}$ than the maximum width $B_{64}$, as measured at a right angle to the closing direction SR, of the carrier body 64 of the transmission element 60.

It can also be seen from FIG. 4 that the guide track 52 has a maximum guide track width $B_{max}$ measured at a right angle to the closing direction SR. That maximum width $B_{max}$ is also shown once again in FIGS. 5*a* and 5*c*. As viewed in the closing direction SR, the synchronization coupling element 63 and the ejection force storage means (ejection force accumulator) 42 are arranged within that guide track width $B_{max}$, as is shown by the broken line in FIG. 5*a*. As a result the drive device 1 is of a relatively narrow configuration.

Figure 5A:
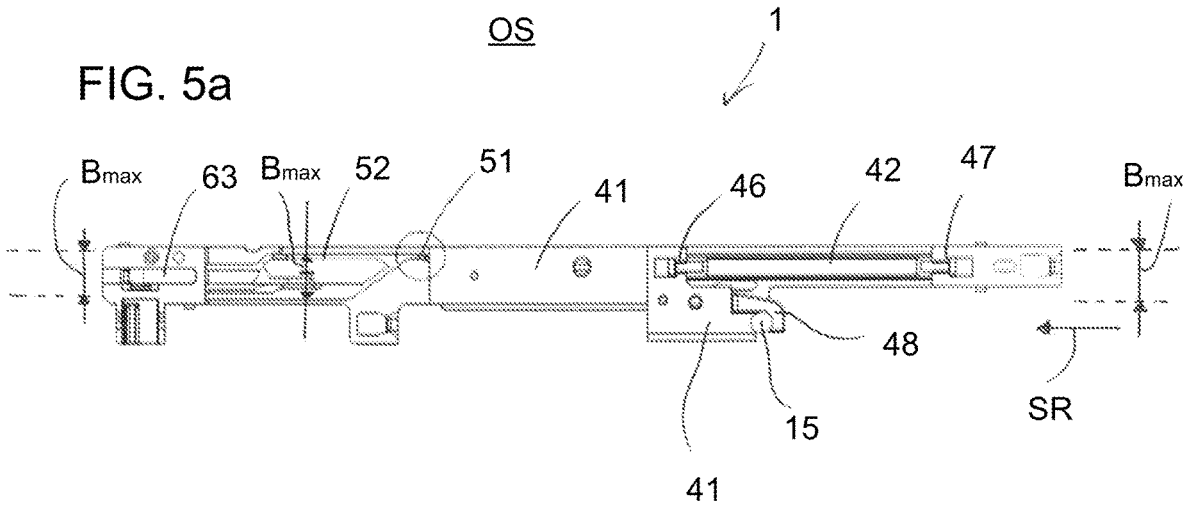
FIGS. 5*a*-5*c* are various views of the drive device in the open position.
Figure 5B:
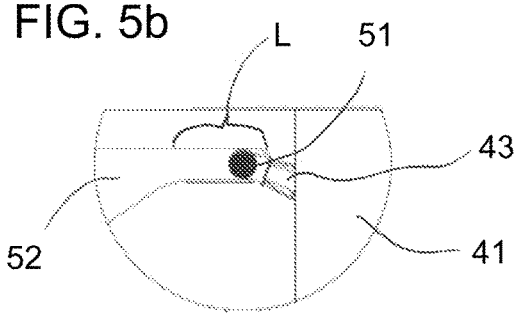

FIG. 5*a* shows a plan view of the assembled drive device 1. The ejection force storage means 42 is held to the two force storage means bases 46 and 47. The entrainment member 15 is caught between the entrainment member catch lever 48 and the ejection slide 41. The left-hand region of FIG. 5*a* shows the side of the synchronization coupling element 63, which faces away from the teeth 67. The guide track 52 provided in the carrier 3 can be seen here. The synchronization coupling element 63 is disposed in the closing direction SR behind the guide track 52, while the ejection force storage means 42 is disposed in the closing direction SR in front of the guide track 52. The locking pin 51 guided in the guide track 52 is disposed in FIG. 5*a* entirely at the (right-hand) end of the guide track 52 in a mounting portion L. That position of the drive device 1 shown in FIG. 5*a* corresponds to a completely open position OS of the moveable furniture part 2. In matching relationship therewith, the detail in FIG. 5*b* shows that the locking pin 51 on the control lever 43 is disposed in the mounting portion L.

Figure 5C:
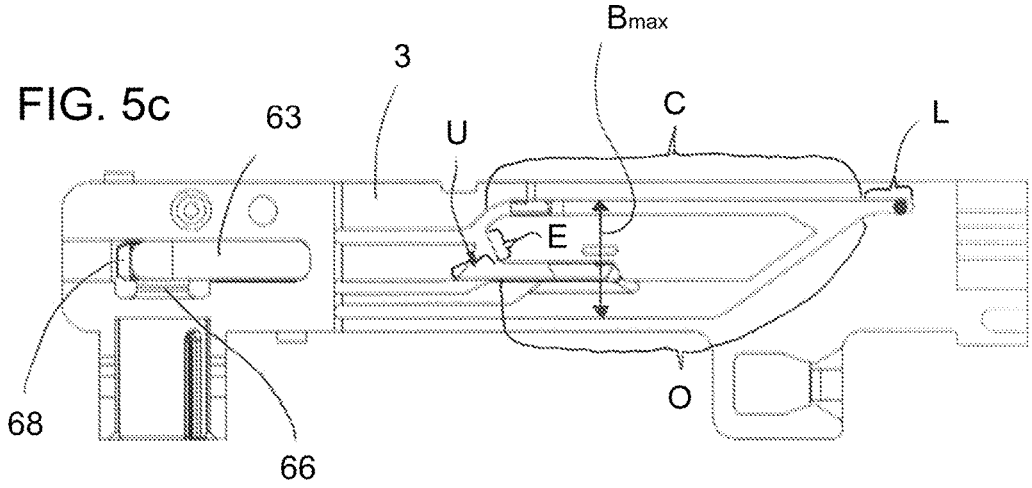

FIG. 5*c* shows a plan view of a part of the drive device 1 shown in FIG. 5*a*, with the right-hand region and the ejection slide 41 not being shown. The locking pin 51 is disposed in the mounting portion L of the guide track 52. The guide track 52 also has the closing portion C in which the locking pin 51 is moveable upon a closing movement of the moveable furniture part 2. There then follows the latching portion E in which the locking pin 51 is moveable after leaving the closing portion C. That is then followed by the overpressing portion U. That is in turn adjoined by the opening portion O in which the locking pin 51 is moveable upon opening or ejection of the moveable furniture part 2. That opening portion O finally transitions again into the mounting portion L or into the closing portion C, respectively. It is also possible to see in the left-hand region of FIG. 5*c*, beside the rear side of the synchronization coupling element 63, a tooth 68 of the synchronization coupling counterpart element 66.

Figure 6A:
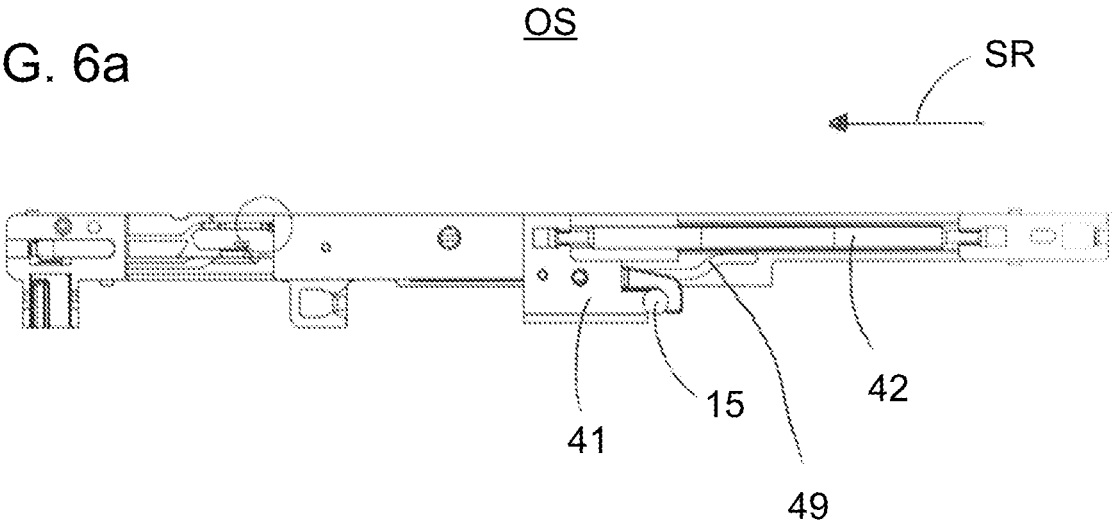
FIGS. 6*a*-6*b* are various views of the drive device upon closing.

In FIG. 6*a*, the moveable furniture part 2 has moved in the closing direction SR but is still in an open position OS. By virtue of the closing movement, the entrainment member 15 associated with the moveable furniture part 2 is moved in the closing direction SR and in so doing entrains the ejection slide 41. As a result, the ejection slide 41 moves relative to the carrier 3 and the ejection force storage means 42 is stressed.

Figure 6B:
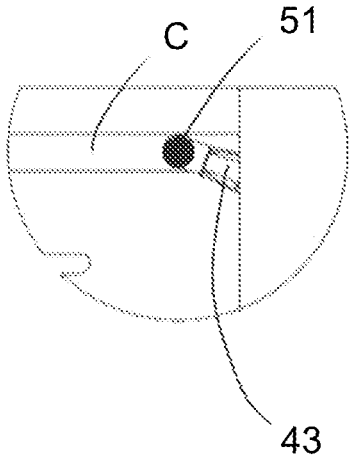

In the detail shown in FIG. 6*b*, it can be seen that the locking pin 51 is no longer in the mounting portion L but in the closing portion C of the guide track 52.

Figure 7A:
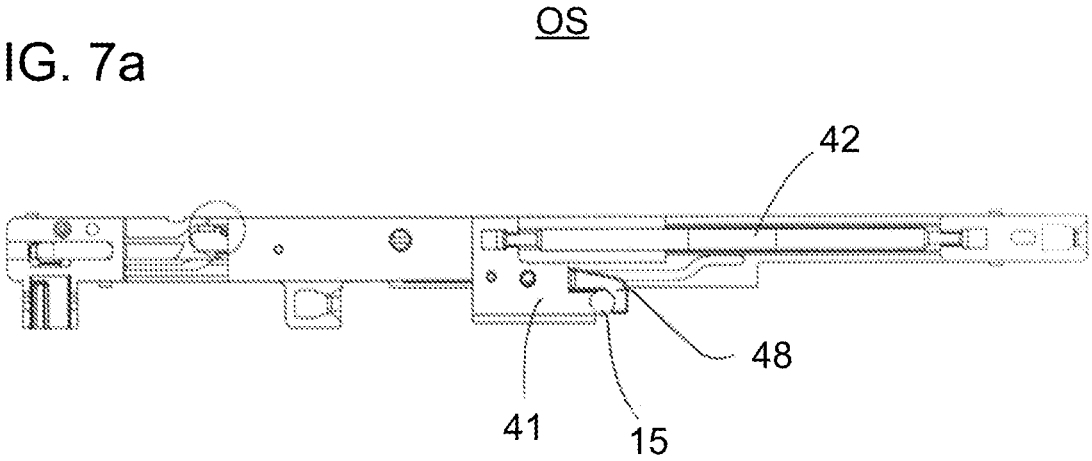
FIGS. 7*a*-7*c* are various views of the drive device upon abutment of the locking pin against the second transmission abutment.

Referring to FIG. 7*a*, the moveable furniture part 2 and therewith the ejection slide 41 have moved still further in the closing direction SR. The moveable furniture part 2 however is still in the open position OS. The ejection force storage means 42 has been still further stressed.

Figure 7B:
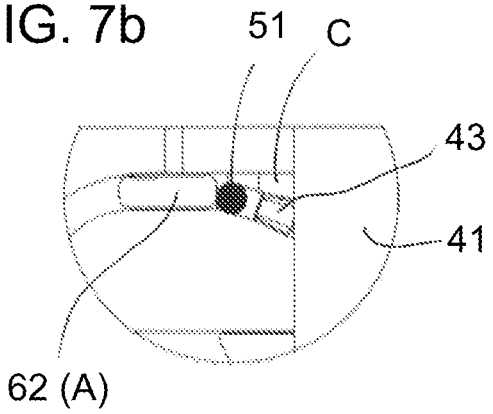

In the detail view shown in FIG. 7*b*, the locking pin 51 has moved in the closing portion C to such an extent that the locking pin 51 abuts against the second transmission abutment 62 which projects into the guide track 52. In specific terms, the transmission element 60 of the synchronization device 6 has that second transmission abutment 62 which projects into the closing portion C of the guide track 52. The second transmission abutment 62 is in the abutment position A.

Figure 7C:
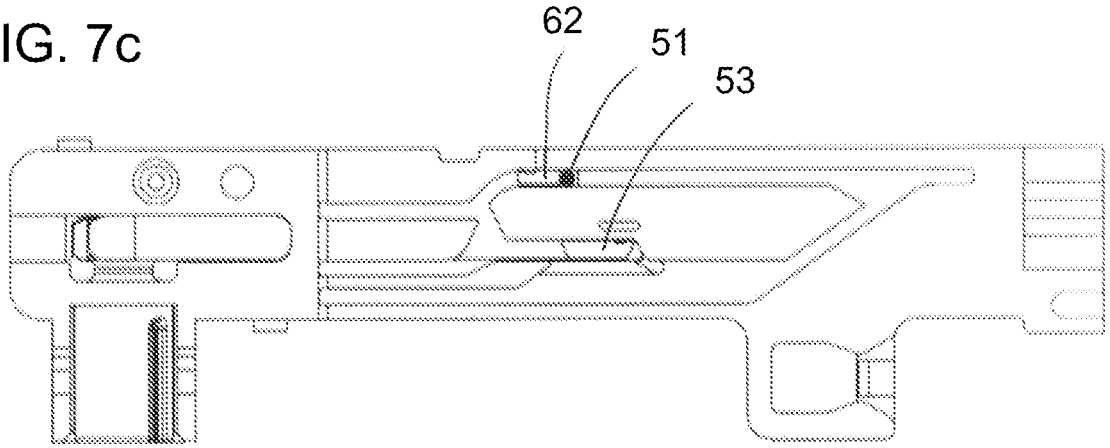

FIG. 7*c* again shows the drive device 1 with the ejection slide 41 faded out.

Figure 8A:
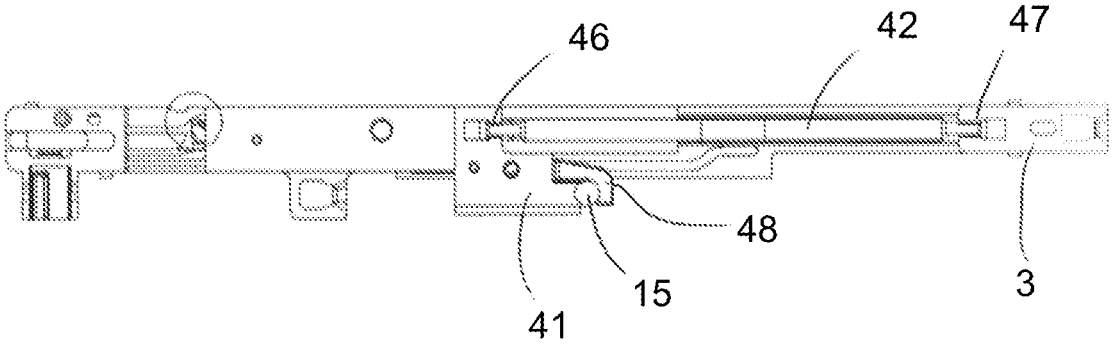
FIGS. 8*a*-8*c* are various views of the drive device upon release of the locking pin from the second transmission abutment.

Referring to FIG. 8*a* the moveable furniture part 2 has been moved still further in the closing direction SR but the closed position SS has just not yet been reached. Accordingly, the moveable furniture part 2 is still in the open position SS. The ejection force storage means 42 is almost completely stressed.

Figure 8B:
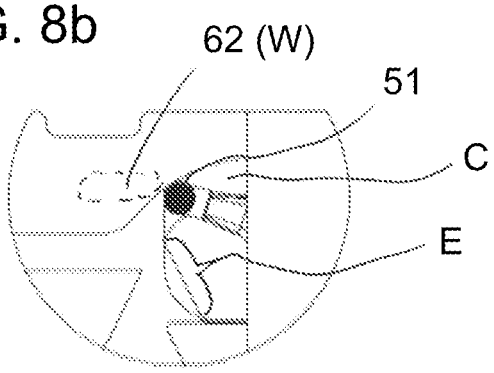
Figure 8C:
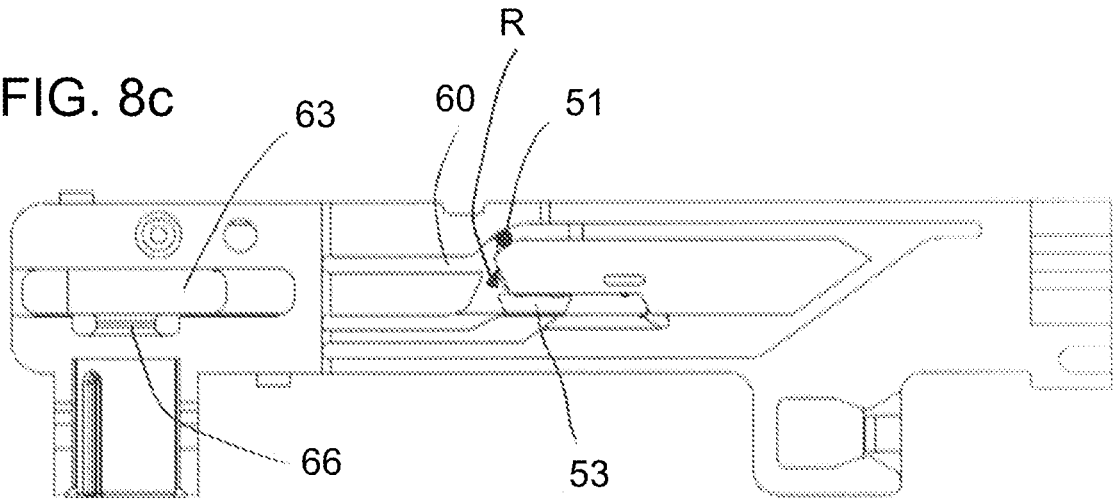

Because the locking pin 51 bears against the second transmission abutment 62 in the abutment position A the transmission element 60 in the closing movement (from FIG. 7*a* to FIG. 8*a*) is moveable by the locking pin 51 by way of that second transmission abutment 62. The second transmission abutment 62 is moveable by the locking pin 51 from the abutment position A into the (sunk) evasion position W (see the broken line in FIG. 8*b*) in which the second transmission abutment 62 no longer projects into the guide track 52 and the locking pin 51 disengages from the second transmission abutment 62. That movement of the second transmission abutment 62 into the evasion position W enables a further movement of the locking pin 51 into the latching portion E.

It can be seen from FIG. 8*a* that it is (exclusively) by the movement of the transmission element 60, that is triggered in the closing movement by the locking pin 51 by the second transmission abutment 62, that the locking element 53 (on the transmission element 60) is moveable into a latching recess-forming position in which the locking element 53 forms the latching recess R of the guide track 52. The synchronization coupling element 63 is also moved at the same time with that movement of the transmission element 60, which in turn triggers a rotary movement of the synchronization coupling counterpart element 66. That rotary movement is transmitted to a second drive device 1' by way of the synchronization bar 65. Accordingly this last portion of the closing movement in the closing portion C is synchronized.

Figure 9A:
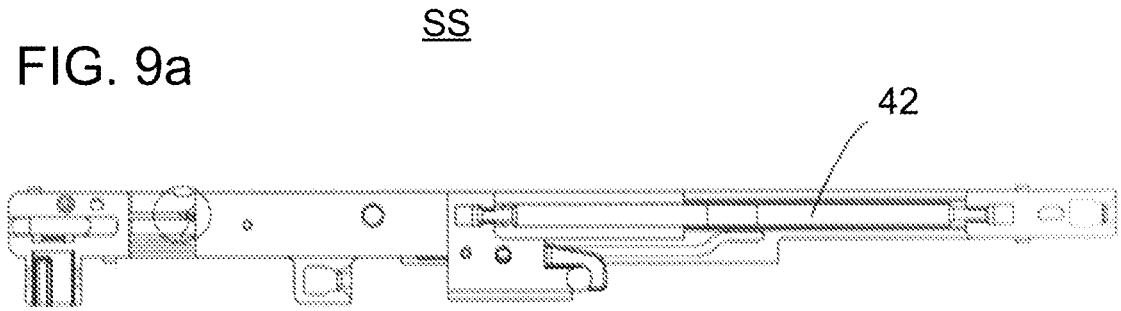
FIGS. 9*a*-9*c* are various views of the drive device in the closed position.

As shown in FIG. 9*a* the moveable furniture part 2 has been moved still further in the closing direction SR whereby the closed position SS is reached. The ejection force storage means 42 is fully stressed.

Figure 9B:
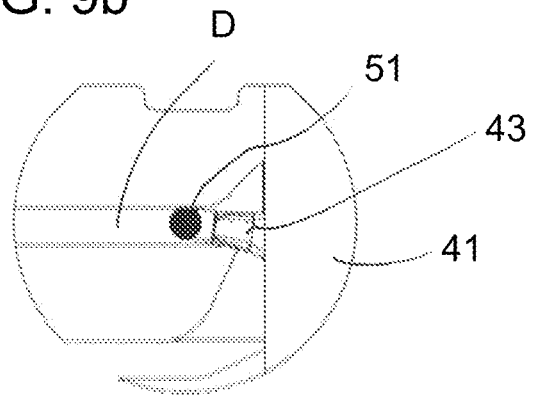
Figure 9C:
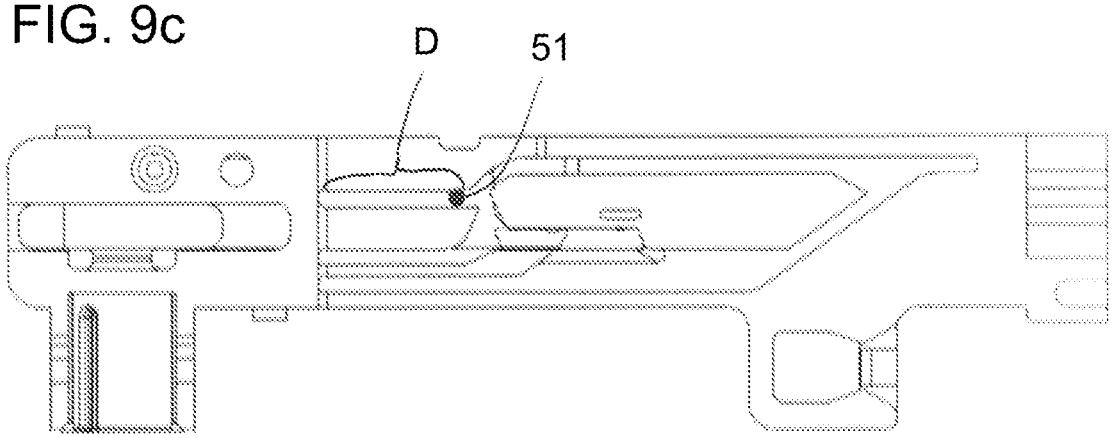

As can be seen in FIGS. 9*b* and 9*c* the locking pin 51 has even moved into the pressing-through prevention passage D of the guide track 52. The transmission element 60 remains stationary in that (pushing-through) movement. That is to say, there is no synchronization or transmission of movement to the second drive device 1'.

Figure 10A:
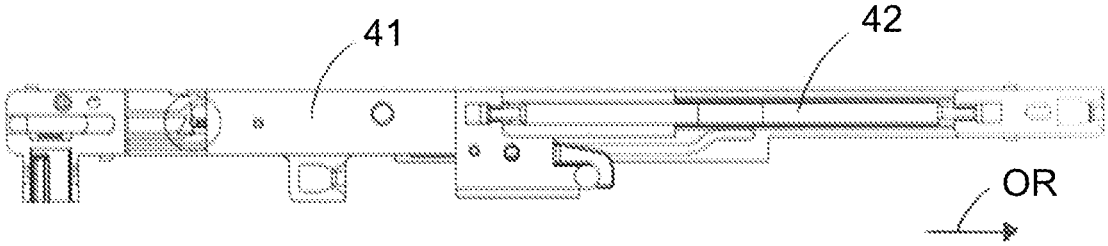
FIGS. 10*a*-10*c* are various views of the drive device in the locking position.
Figure 10B:
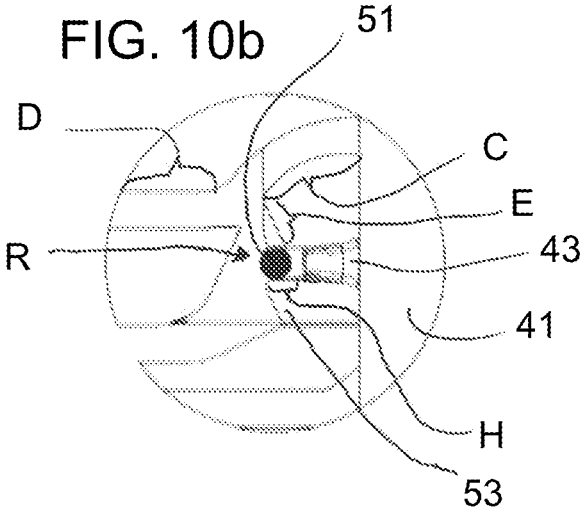
Figure 10C:
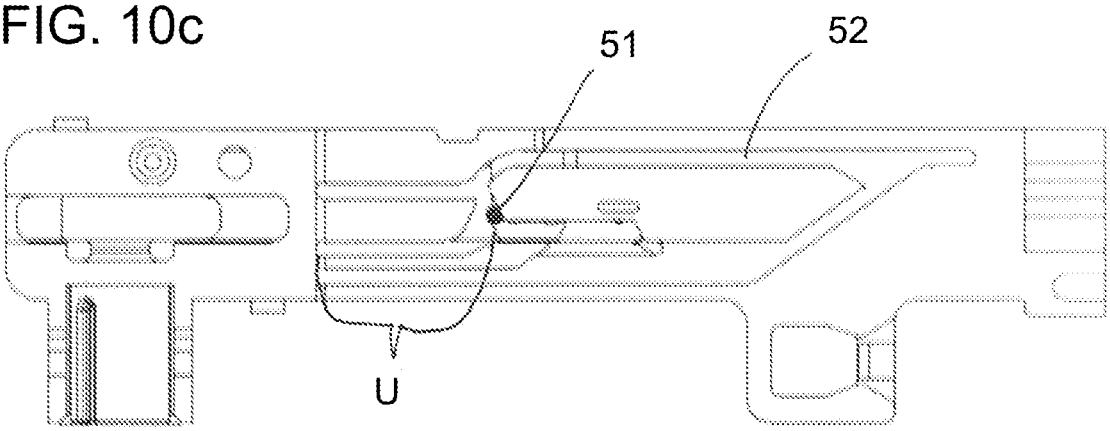

If, in that position as shown in FIGS. 10*a* through 10*c*, the user ceases pressing against the moveable furniture part 2, then the ejection force storage means 42 can be slightly relieved and in that case moves the ejection slide 41 slightly in the opening direction OR so that the locking pin 51 moves along the latching portion E until the locking pin 51 latches in the latching recess R. That gives the locking position VS of the locking device 5, as is shown in FIGS. 5*a*, 5*b* and 5*c*. The latching recess R is formed by the last region of the latching portion E and by the holding surface of the locking element 53. The transmission element 60 remains stationary even in that movement of the locking pin 51 in the latching portion E. In other words, there is no synchronization or transmission of movement to the second drive device 1'.

Figure 11A:
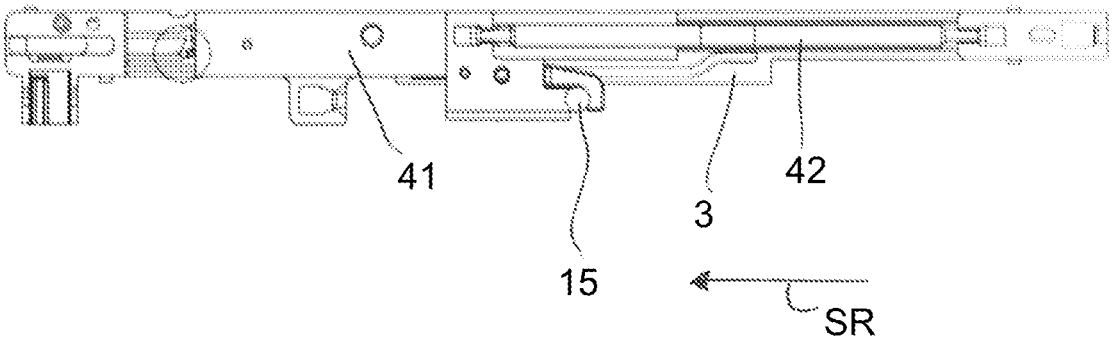
FIGS. 11*a*-11*c* are various views of the drive device in the overpressing position.
Figure 11B:
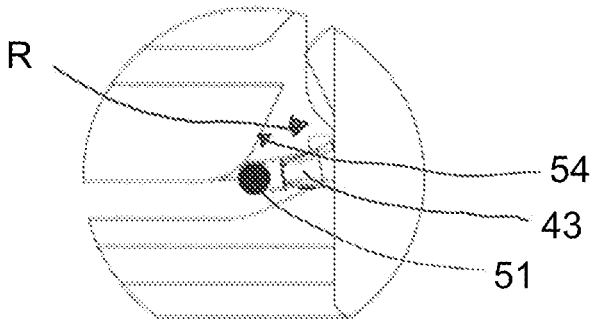
Figure 11C:
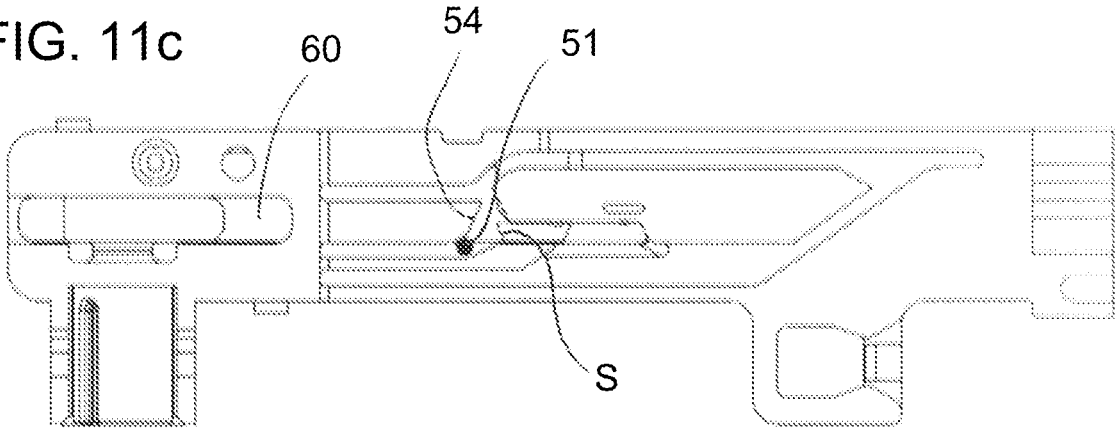

FIGS. 11*a*, 11*b* and 11*c* show the overpressing movement. When pressure is applied in the closing direction SR to the moveable furniture part 2 which is in the closed position SS as shown in FIGS. 10*a* through 10*c* the moveable furniture part 2 moves into the overpressing position ÜS. That overpressing movement of the moveable furniture part is transmitted by the entrainment member 15 to the ejection slide 41 of the ejection device 4 and to the control lever 43 connected to the ejection slide so that the locking pin 51 on the control lever 43 is released from the latching recess R, is deflected by the inclined deflection portion 55 and passes into the overpressing portion U (with overpressing passage) of the guide track 52. The control lever 43 is still further pivoted in the counter-clockwise direction by that deflection. The locking position VS is nullified and the locking device 5 is unlocked. The transmission element 6 also remains stationary in that overpressing movement.

Figure 12A:
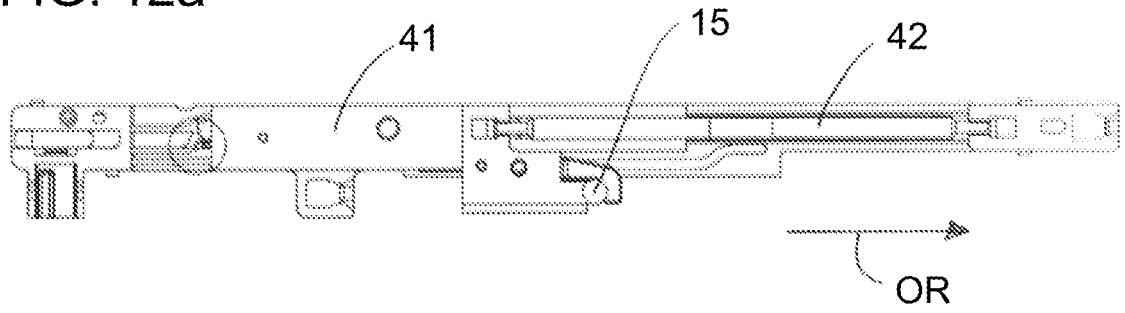
FIGS. 12*a*-12*c* are various views of the drive device upon abutment of the locking pin against the first transmission abutment.
Figure 12B:
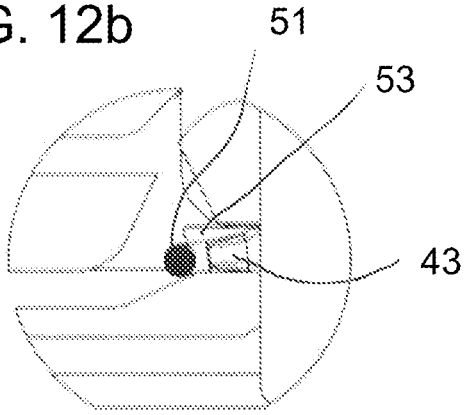
Figure 12C:
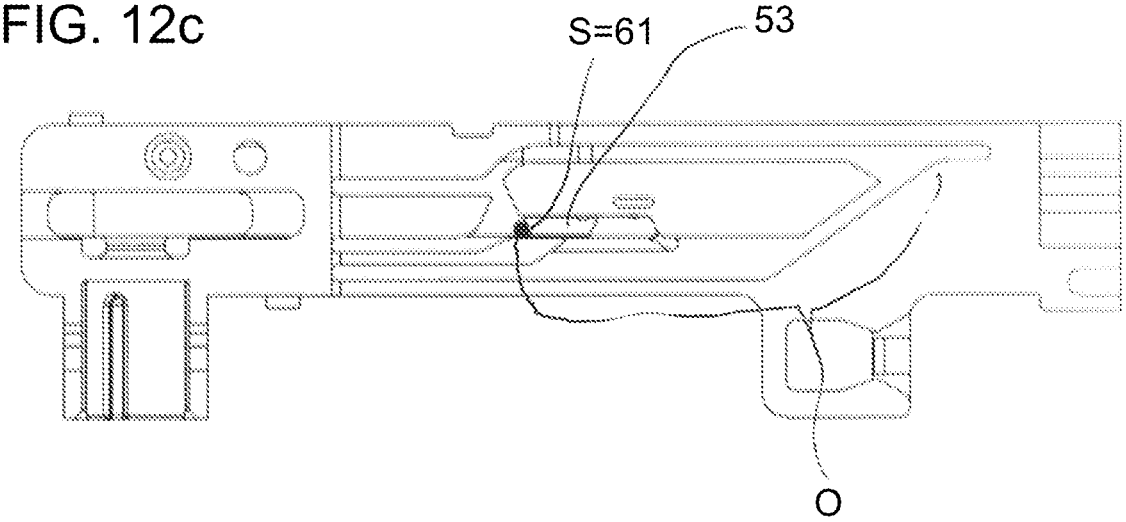

If, in that overpressing position ÜS shown in FIGS. 11*a* through 11*c* the user ceases to press against the moveable furniture part 2, the ejection force storage means 42 can be relieved as the locking pin 51 is no longer locked. By virtue of that relief effect, the ejection slide 41 and therewith the locking pin 51 are moved along the opening portion O of the guide track 52. In that movement, the locking pin 51 firstly encounters the end face S on the locking element 53. In FIG. 12*b*, the locking pin 51 is just encountering that end face S. In FIG. 12*c*, the locking pin 51 has already moved the locking element 53 slightly in the opening direction OR by way of the end face S. The first transmission abutment 61 is formed by that end face S which is provided on the locking element 53 and which is oriented transversely relative to the holding surface H. The transmission element 60 is moveable in the opening movement by the locking pin 51 by virtue of that first transmission abutment 61 which projects into the opening portion O of the guide track 52. Accordingly, synchronization or transmission of movement in respect of that opening movement to the second drive device 1' takes place. If unlocking has not yet taken place in the second drive device 1' in spite of overpressing of the moveable furniture part 2—for whatever reasons—then the locking element 53 of the second drive device 1' is moved in the opening direction OR by that synchronization effect so that the locking element 53 no longer constitutes the latching recess R and the locking pin 53 of the second drive device 1' is unlocked.

Figure 13A:
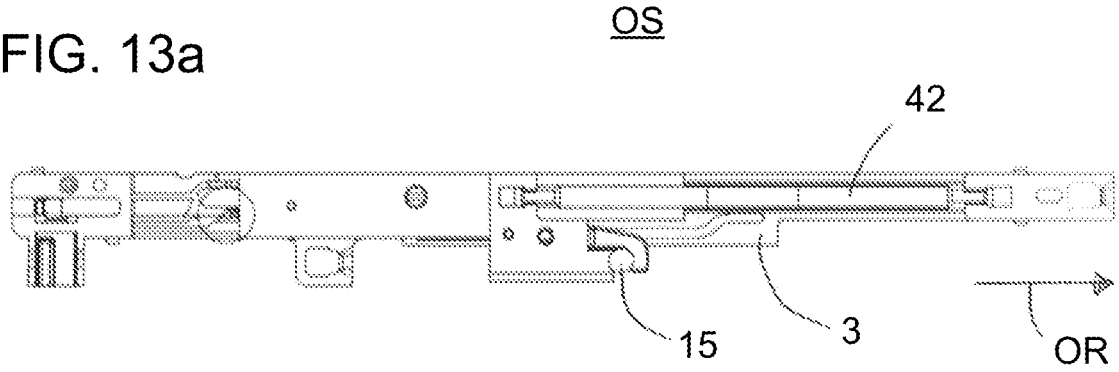
FIGS. 13*a*-13*c* are various views of the drive device upon release of the locking pin from the first transmission abutment.
Figure 13B:
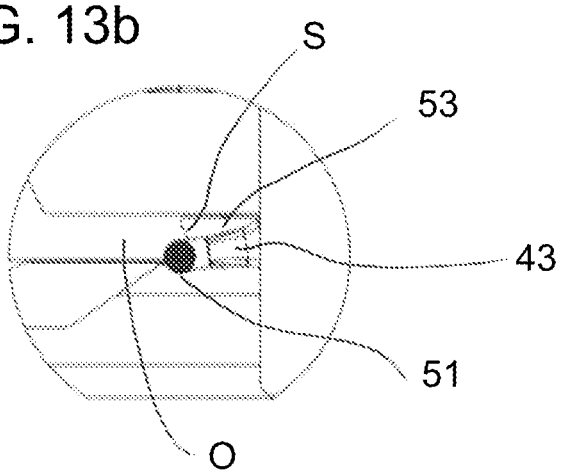
Figure 13C:
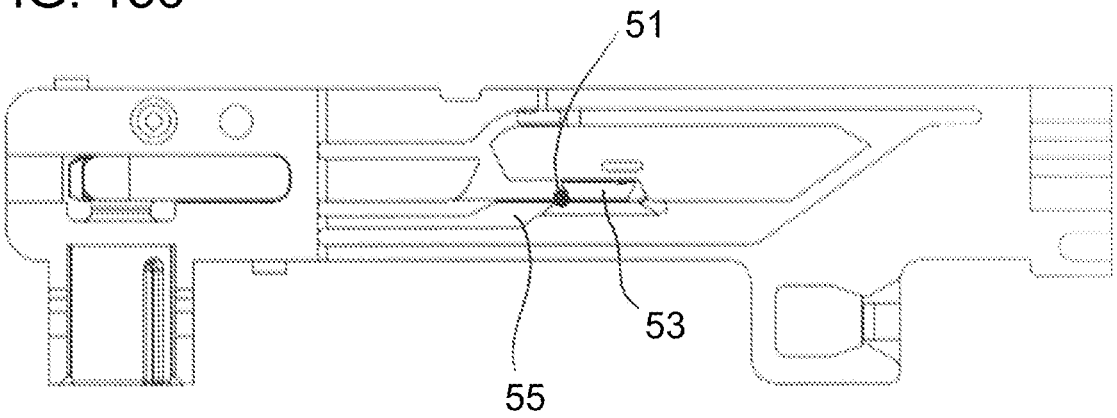

In FIGS. 13*a*, 13*b* and 13*c*, the ejection force storage means 42 has been relieved of stress still a little further so that the open position OS of the moveable furniture part 2 is reached. The locking pin 51 still bears against the end face S of the locking element 53, but is already deflected by that inclined end face S by virtue of the gap between the locking element 53 and the peninsular-shaped region 55 of the guide track 52. The movement of the transmission element 60 and thus synchronization of the second drive device 1' is thus concluded.

Figure 14A:
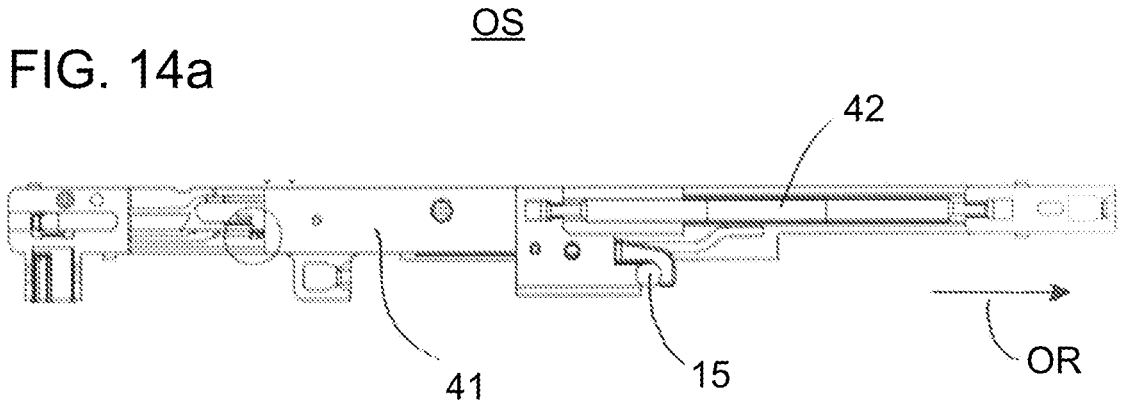
FIGS. 14*a*-14*c* are various views of the drive device during the ejection movement.
Figure 14B:
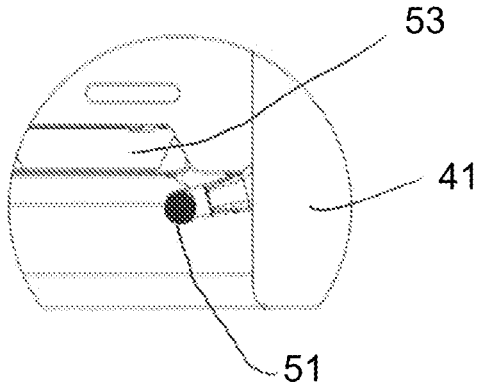
Figure 14C:
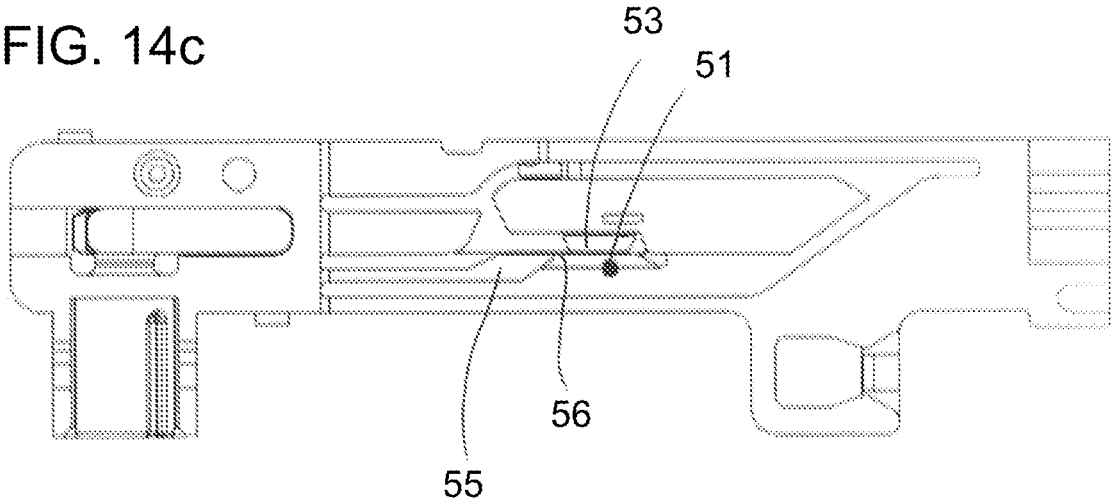

In FIGS. 14*a*, 14*b* and 14*c*, the ejection force storage means 42 has been still further relieved of stress. The locking pin 51 has moved entirely through the gap 56.

Figure 15:
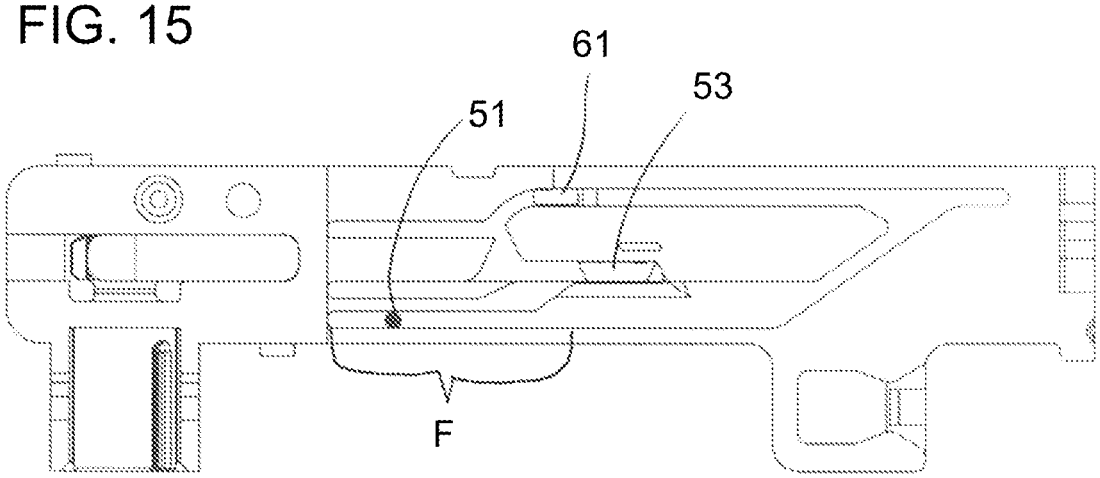
FIG. 15 is a plan view of a part of the drive device with the locking pin in the run-free passage.

If, starting from that position as shown in FIGS. 14*a* through 14*c*—in which actually the ejection movement by the ejection device 4 takes place—a pressing force is by mistake applied to the moveable furniture part 2 in the closing direction SR, then the locking pin 51, by virtue of the configuration of the opening portion O, cannot pass into the overpressing portion U or into the latching recess R again. For that reason, the guide track 52 has the run-free passage F shown in FIG. 15. It is therein that the locking pin 51 can move non-destructively in the event of an excessively early closing movement implemented by mistake.

Figure 16A:
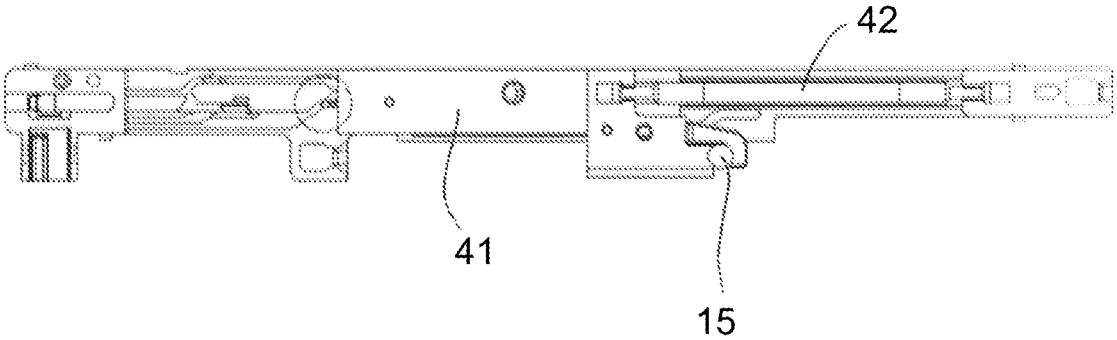
FIGS. 16*a*-16*c* are various views of the drive device in the open position.
Figure 16B:
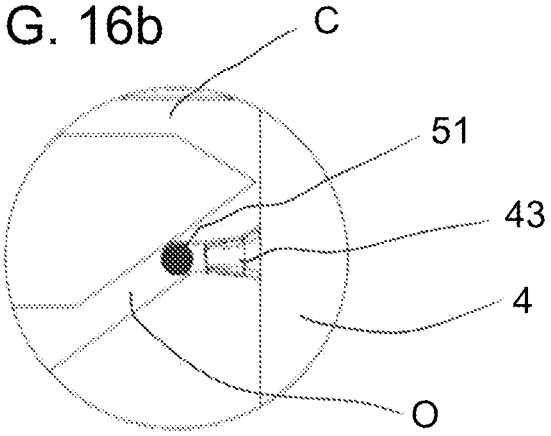
Figure 16C:
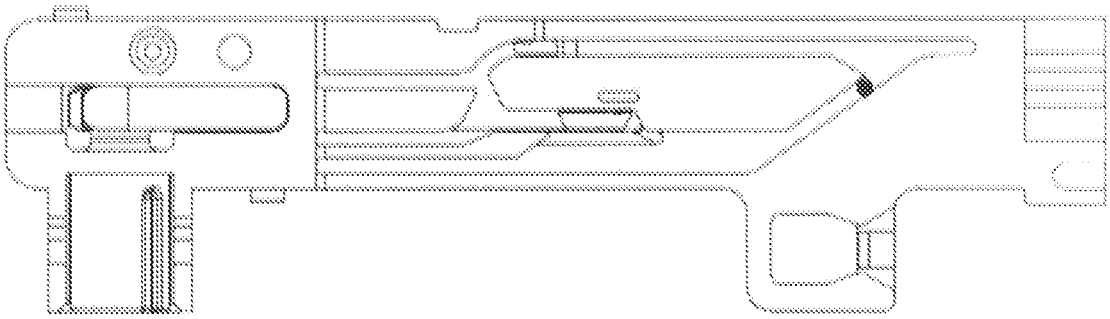

In FIGS. 16*a*, 16*b* and 16*c* the ejection or opening movement is almost concluded. The locking pin 51 is disposed in the last region of the opening portion O. The ejection force storage means 42 is almost completely relieved of stress or load.

Finally, the moveable furniture part 2 and the drive device 1 pass again into the position shown in FIGS. 5*a* through 5*c*. If in that position a user further pulls on the moveable furniture part in the opening direction OR then the entrainment catch lever 48 is rotated in the counter-clockwise direction about the axis of rotation $X_{44}$ by virtue of the cardioid configuration of the sliding guide track 49. As a result the entrainment member 15 is no longer caught between the ejection slide 41 and the lever 48.

The moveable furniture part 2 can be freely moved. The drive device 1 is stationary and is not influenced by the moveable furniture part 2.

LIST OF REFERENCES

1 (first) drive device
1' second drive device
2 moveable furniture part
3 carrier
4 ejection device
41 ejection slide
42 ejection force storage means
43 control lever
44 axis of rotation counterpart portion
axis of rotation counterpart portion
46 first force storage means base
47 second force storage means base
48 entrainment member catch lever
49 sliding guide track
locking device
51 locking pin
52 guide track
53 locking element
54 inclined deflection portion
55 peninsular region
56 gap
6 synchronization device
60 transmission element
61 first transmission abutment
62 second transmission abutment
63 synchronization coupling element
64 carrier body
65 synchronization bar
66 synchronization coupling counterpart elements
67 teeth
68 teeth
69 receiving means
7 arrangement
8 article of furniture
9 furniture carcass
10 drawer receptacle box
11 front panel
12 drawer extension guide assembly
13 drawer rail
14 carcass rail
15 entrainment member
16 retraction device
SS closed position
OS open position
ÜS overpressing position
VS locking position
R latching recess
H holding surface
O opening portion
S end face
C closing portion
A abutment position
W evasion position
E latching portion
U overpressing portion
L mounting portion
D pressing-through prevention passage
F run-free passage
SR closing direction
OR opening direction
$B_{max}$ maximum guide track width
$B_{63}$ maximum width of the synchronization coupling element
$B_{64}$ maximum width of the carrier body
$X_{44}$ axis of rotation
$X_{45}$ axis of rotation

The invention claimed is:

1. A drive device for moving a moveable furniture part, comprising:

a carrier to extend in a closing direction of the moveable furniture part, an ejection device for ejecting the moveable furniture part out of a closed position into an open position, the ejection device having an ejection slide moveable relative to the carrier and an ejection force accumulator having a first end fixed to the carrier and a second end fixed to the ejection slide, the ejection device being unlockable out of a locking position by an overpressing movement of the moveable furniture part into an overpressing position behind the closed position, a locking device for locking the ejection device in the locking position, the locking device including:

a locking pin connected to the ejection device, and a guide track at least partially in or on the carrier for guiding the locking pin, the locking pin being locked in a latching recess in the guide track in the locking position, and a synchronization device for synchronizing a movement of the drive device with a second drive device, the synchronization device including:

a transmission element mounted moveably to the carrier and being moveable by the locking pin, and a synchronization coupling element connected to the transmission element, wherein the guide track has a maximum guide track width measured perpendicular to the closing direction, end points of the maximum guide track width being located in respective parallel boundary planes oriented parallel to the closing direction and perpendicular to a direction of the maximum guide track width, and the synchronization coupling element and the ejection force accumulator being arranged such that, when viewed in the closing direction, the synchronization coupling element and the ejection force accumulator are located entirely within the maximum guide track width and entirely between the parallel boundary planes, and wherein the locking pin is locked in the latching recess of the guide track in the locking position, the latching recess being at least partially formed by a locking element moveable relative to the carrier, and the locking pin is held to the locking element in the locking position.

2. The drive device as set forth in claim 1, wherein the synchronization coupling element is arranged behind the guide track on the carrier in the closing direction.

3. The drive device as set forth in claim 1, wherein the ejection force accumulator is arranged in front of the guide track in the closing direction.

4. The drive device as set forth in claim 1, wherein the synchronization coupling element as measured at a right angle to the closing direction has a smaller maximum width than a maximum width of a carrier body of the transmission element as measured perpendicular to the closing direction.

5. The drive device as set forth in claim 1, wherein the locking element is arranged at the transmission element.

6. The drive device as set forth in claim 1, wherein the transmission element is moveable linearly in the closing direction.

7. An arrangement comprising:

a first drive device and a second drive device each configured as set forth in claim 1, and a synchronization bar for connecting the synchronization device of the first drive device and the synchronization device of the second drive device.

8. An article of furniture comprising:

a furniture carcass;

a furniture part moveable relative to the furniture carcass; and the arrangement as set forth in claim 7.

9. The arrangement as set forth in claim 7, wherein the synchronization device of each of the first drive device and the second drive device further includes a synchronization coupling counterpart element rotatably mounted to the carrier, the synchronization coupling counterpart element being configured to be coupled to the synchronization coupling element in a motion-transmitting relationship, and the synchronization bar is configured to connect the synchronization coupling counterpart element of the first drive device and the synchronization coupling counterpart element of the second drive device.

10. A drive device for moving a moveable furniture part, comprising:

a carrier to extend in a closing direction of the moveable furniture part, an ejection device for ejecting the moveable furniture part out of a closed position into an open position, the ejection device having an ejection slide moveable relative to the carrier and an ejection force accumulator having a first end fixed to the carrier and a second end fixed to the ejection slide, the ejection device being unlockable out of a locking position by an overpressing movement of the moveable furniture part into an overpressing position behind the closed position, a locking device for locking the ejection device in the locking position, the locking device including:

a locking pin connected to the ejection device, and a guide track at least partially in or on the carrier for guiding the locking pin, the locking pin being locked in a latching recess in the guide track in the locking position, and a synchronization device for synchronizing a movement of the drive device with a second drive device, the synchronization device including:

a transmission element mounted moveably to the carrier and being moveable by the locking pin, and a synchronization coupling element connected to the transmission element, wherein the guide track has a maximum guide track width measured perpendicular to the closing direction, end points of the maximum guide track width being located in respective parallel boundary planes oriented parallel to the closing direction and perpendicular to a direction of the maximum guide track width, and the synchronization coupling element and the ejection force accumulator being arranged such that, when viewed in the closing direction, the synchronization coupling element and the ejection force accumulator are located entirely within the maximum guide track width and entirely between the parallel boundary planes, and wherein the synchronization coupling element has a plurality of teeth spaced from each other in the closing direction.

11. A drive device for moving a moveable furniture part, comprising:

a carrier to extend in a closing direction of the moveable furniture part, an ejection device for ejecting the moveable furniture part out of a closed position into an open position, the ejection device having an ejection slide moveable relative to the carrier and an ejection force accumulator having a first end fixed to the carrier and a second end fixed to the ejection slide, the ejection device being unlockable out of a locking position by an overpressing movement of the moveable furniture part into an overpressing position behind the closed position, a locking device for locking the ejection device in the locking position, the locking device including:

a locking pin connected to the ejection device, and a guide track at least partially in or on the carrier for guiding the locking pin, the locking pin being locked in a latching recess in the guide track in the locking position, and a synchronization device for synchronizing a movement of the drive device with a second drive device, the synchronization device including:

a transmission element mounted moveably to the carrier and being moveable by the locking pin, and a synchronization coupling element connected to the transmission element, wherein the guide track has a maximum guide track width measured perpendicular to the closing direction, end points of the maximum guide track width being located in respective parallel boundary planes oriented parallel to the closing direction and perpendicular to a direction of the maximum guide track width, and the synchronization coupling element and the ejection force accumulator being arranged such that, when viewed in the closing direction, the synchronization coupling element and the ejection force accumulator are located entirely within the maximum guide track width and entirely between the parallel boundary planes, and wherein the synchronization device further includes a synchronization coupling counterpart element rotatably mounted to the carrier, the synchronization coupling counterpart element being configured to be coupled to the synchronization coupling element in a motion-transmitting relationship.

12. The drive device as set forth in claim 11, wherein the synchronization coupling counterpart element is a toothed wheel.

* * * * *